US006948453B1

(12) United States Patent
DeAngelo et al.

(10) Patent No.: US 6,948,453 B1
(45) Date of Patent: Sep. 27, 2005

(54) HYDROCARBON CRACKING

(75) Inventors: David J. DeAngelo, Coal City, IL (US); Denise R. Karstensen, Morris, IL (US); Bala S. Devakottai, Sugar Land, TX (US); Shane L. Fandry, Houston, TX (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 10/918,164

(22) Filed: Aug. 13, 2004

(51) Int. Cl.[7] ..... F28D 7/00
(52) U.S. Cl. ..... 122/32; 122/31.1; 165/159
(58) Field of Search ..... 122/32, 31.1, 387, 122/379, 438, 487; 165/159, 158, 174, 134.1

(56) References Cited

U.S. PATENT DOCUMENTS

| | | | | |
|---|---|---|---|---|
| 3,688,494 | A * | 9/1972 | Mevenkamp et al. | 60/780 |
| 3,818,975 | A * | 6/1974 | Tokumitsu et al. | 165/95 |
| 4,244,423 | A * | 1/1981 | Thut et al. | 165/82 |
| 4,700,773 | A * | 10/1987 | Kehrer | 165/134.1 |
| 5,630,470 | A * | 5/1997 | Lockwood, Jr. | 165/82 |
| 6,032,616 | A * | 3/2000 | Jones | 122/32 |

* cited by examiner

*Primary Examiner*—Gregory Wilson
(74) *Attorney, Agent, or Firm*—Roderick W. MacDonald

(57) ABSTRACT

A method for controlling fouling of a heat exchanger that operates downstream of a cracking furnace by injecting liquid water upstream of the heat exchanger.

10 Claims, 4 Drawing Sheets

HYDROCARBON CRACKING

BACKGROUND OF THE INVENTION

1. Field of the Invention

This invention relates to the thermal cracking of a hydrocarbonaceous material in a pyrolysis furnace. More particularly, this invention relates to reducing coke fouling during the transfer of the cracked product from the furnace through a shell and tube type, first heat exchanger encountered by that product after leaving the furnace.

2. Description of the Prior Art

Thermal cracking of hydrocarbons is a petrochemical process that is widely used to produce olefins such as ethylene, propylene, butenes, butadiene, and aromatics such as benzene toluene, and xylenes. In an olefin production plant, a hydrocarbonaceous feedstock such as ethane, naphtha, gas oil, or other fractions of whole crude oil is mixed with steam which serves as a diluent to keep the hydrocarbon molecules separated. This mixture, after preheating, is subjected to severe hydrocarbon thermal cracking at elevated temperatures (1,450 to 1,550° F.) in a pyrolysis furnace (steam cracker or cracker).

The cracked product effluent (product) from the pyrolysis furnace (furnace) contains hot, gaseous hydrocarbons of great variety (from 1 to 35 carbon atoms per molecule or C1 to C35). This furnace product is then subjected to further processing to produce, as products of the olefin plant, various, separate and individual product streams of high purity, e.g., hydrogen, ethylene, and propylene. After the separation of these individual streams, the remaining cracked product contains essentially hydrocarbons with four carbon atoms per molecule (C4's) and heavier (C4+). This remainder is fed to a debutanizer wherein a crude C4 stream is separated as overhead while a C5+ stream is removed as a bottoms product.

The hot, cracked furnace product, upon leaving the furnace, is first introduced into a tube-type heat exchanger wherein, for example, boiler feed water is indirectly heat exchanged with the hot product stream to cool the product to a more manageable level, and to generate high pressure steam for use elsewhere in the plant. The tube type heat exchanger (exchanger) employed is a unit that contains a plurality of heat exchange tubes, e.g., typically from about 50 to about 100 tubes. The number of tubes varies widely depending on a number of variables such as exchanger and tube internal diameters. The tubes ends are spaced apart by a metal member that is termed a tube sheet face.

The transfer (conduction) of product from the furnace to the exchanger is accomplished through a transfer line and a truncated cone adapter which expands from the smaller diameter transfer line to the larger diameter exchanger. The truncated adapter is typically refractory lined incorporating various conical or trumpet style designs intended to distribute the flow evenly across the larger diameter. In the Figures hereinafter the refractory is not shown for sake of clarity since it is well known that the adapter will be refractory lined. The mass flow rate (pounds/second/square foot) of product from the furnace through the transfer line and cone, and into and through the exchanger tubes is relatively constant under normal conditions. The exchanger is an elongated unit, since the tubes in its interior are long in order to achieve as much heat transfer from the product to the boiler feed water as reasonably possible, thereby producing optimal amounts of boiler feed steam.

Steam is expensive, so it is desirable to make as much steam as possible from the hot product before other processing of that product. Accordingly, it is desirable to extract as much steam making capability as possible from the first exchanger that is encountered by the product.

One way to increase the steam generating capability of an existing tube-type exchanger is to increase the length of the tubes, hence, the length of the exchanger itself. Often, due to physical restrictions within the plant, it is not practical to extend an exchanger longitudinally to provide for longer tubes therein.

Another way to increase the steam generating capability of an existing tube-type exchanger is to increase the number of individual tubes thereby enlarging the interior volume of that exchanger. Although this can increase the amount of steam recovered from that exchanger, since the furnace and transfer line are unaltered, the adapter cone angle will be increased for the larger tube sheet diameter and the mass flow rate of product through each individual exchanger tube will be reduced. This can lead to plugging of some or all of the tubes with a hard, graphite-like coke deposit (coke) which in turn reduces the steam generating capability of the exchanger and, ultimately, requires shut down and clean out of the exchanger tubes, a time consuming (typically 7 to 10 days) and expensive effort. When the diameter of the large end of the inlet cone becomes too large the re-circulation and low mass flow in the outer perimeter regions of the cone result in coke formation and deposition in those regions. The industry standard for mass flow through the tubes of an exchanger is from 6 to 10 pounds per second per square foot of tube cross section. This is what is thought to be needed in order to produce an optimal steam output level from an exchanger.

Accordingly, it is desirable to be able to design and operate a heat exchanger with increased steam generating capacity without risk of increased exchanger internal coke plugging even when operating with reduced mass flow of furnace product through the exchanger, and that is what this invention accomplishes.

SUMMARY OF THE INVENTION

In accordance with this invention the steam generating capacity of an exchanger is increased, notwithstanding reduced mass flow of product through the exchanger, with reduced risk of exchanger plugging, by the injection of liquid water (water) in accordance with the detailed description of this invention. Water is injected into at least one location on the transfer line and/or the adapter cone aforesaid.

The advantages of this invention can be accomplished with minimal risk of sufficient liquid water reaching the metal upstream tube sheet face of the exchanger to cause cracking thereof.

DETAILED DESCRIPTION OF THE INVENTION

Figure 1:
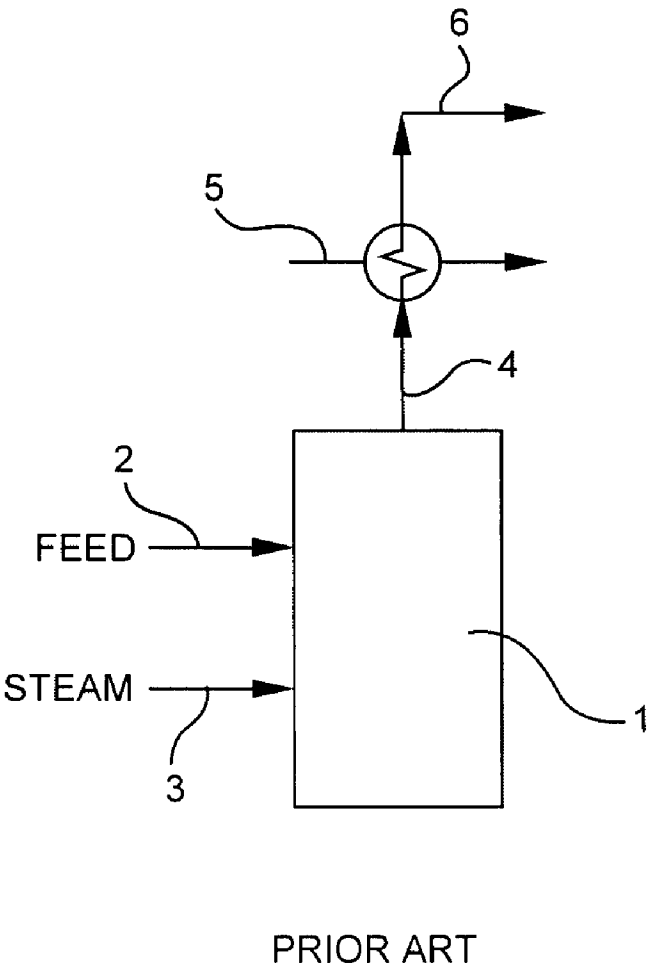
FIG. 1 shows a conventional pyrolysis furnace with a cracked product stream being removed from the furnace to the first heat exchanger to be encountered downstream of the furnace.

FIG. 1 shows an olefin plant pyrolysis furnace 1 having hydrocarbonaceous feed 2 and steam 3 fed thereto for thermal cracking of feed 2 as described above. The cracked product is recovered from the interior of furnace 1 and passed in a first flow direction by way of a transfer line 4 to tube-type heat exchanger 5 to cool such product and generate steam for use in the plant. The thus cooled product is removed from exchanger 5 and passed in a second flow direction by way of 6 to other processing units of the plant.

Figure 2:
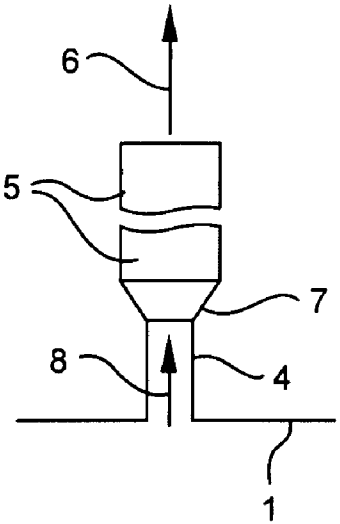
FIG. 2 shows one embodiment of a typical transfer line and adapter cone between a furnace and a vertical exchanger located on top of the radiant box of the furnace.

FIG. 2 shows in greater detail a configuration for bridging the distance between the out let of furnace 1 and the upstream inlet of exchanger 5. In this Figure, transfer line 4 is fixed to and in fluid communication with adapter 7. Adapter 7 is conical in nature, and can be a straight sided classic cone shape or a curved sided trumpet bell shape, both of which are well known in the art. Cracked product 8 passes in a straight first flow direction through transfer line 4, expands inside cone 7, and then into the interior of heat exchange tubes, not shown, in the interior of exchanger 5.

Figure 3:
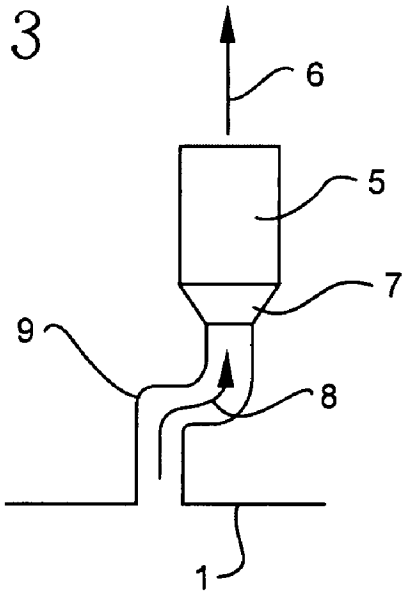
FIG. 3 shows another embodiment of a typical transfer line and adapter cone, with a vertical exchanger located on top of the radiant box of the furnace.

In FIG. 3, transfer line 9 is not straight, but rather makes multiple curves before reaching cone 7.

Figure 4:
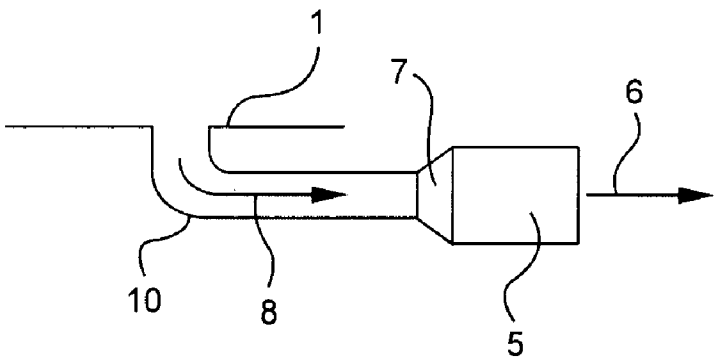
FIG. 4 shows yet another embodiment of a typical transfer line and adapter cone, with a horizontal exchanger located on the ground.

Finally, in FIG. 4, transfer line 10 makes a single essentially right angle turn before reaching cone 7.

This invention is useful with any of the configurations shown in FIGS. 2–4, and any other configurations used for transfer lines and adapter cones between a furnace and the first heat exchanger encountered after leaving the furnace. This invention is also useful with both gas and liquid feed crackers, and is most beneficial with gas fed, e.g., ethane, crackers.

Figure 5:
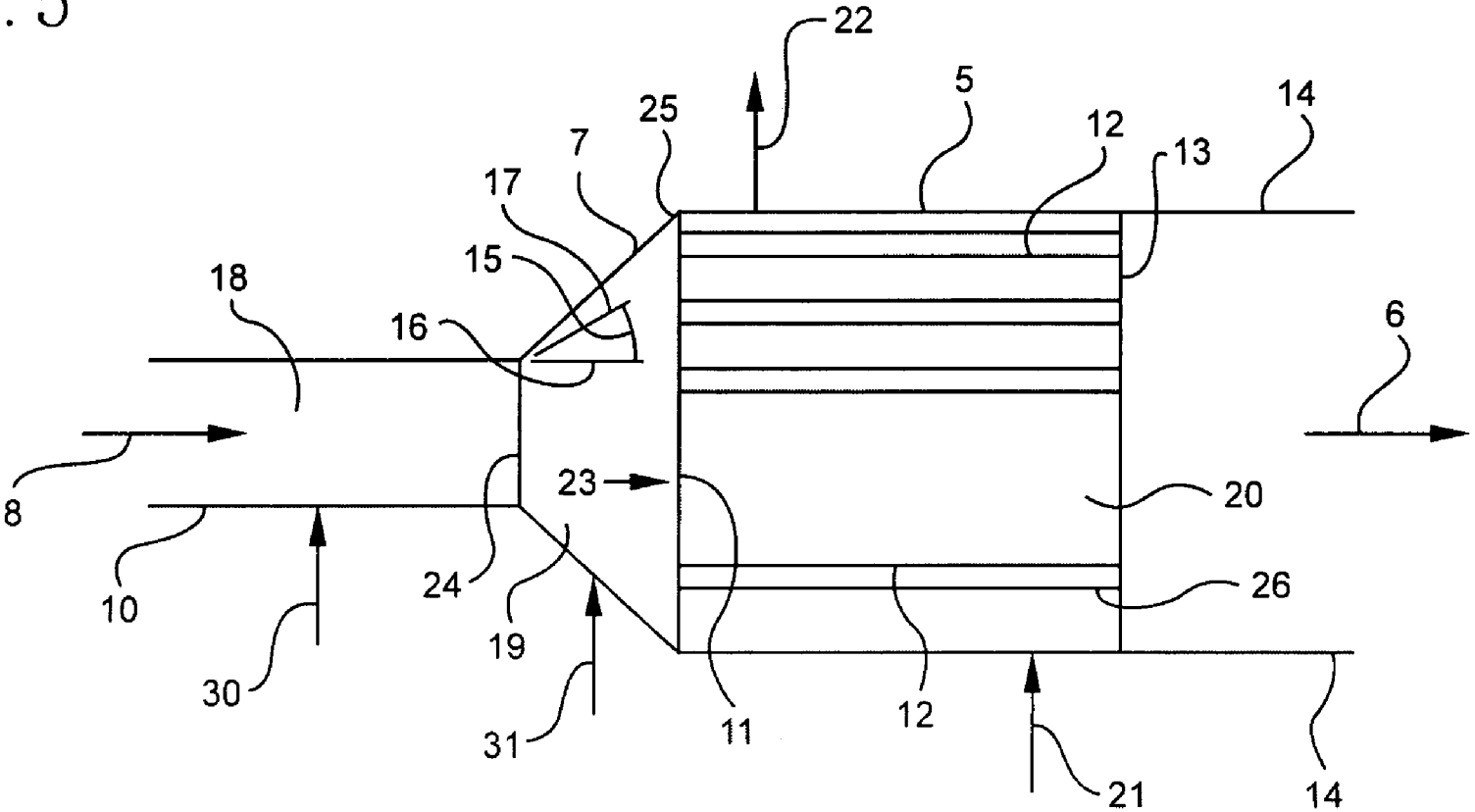
FIG. 5 shows a conventional configuration for a transfer line, adapter cone, and exchanger modified for use in accordance with this invention.

FIG. 5 shows transfer line 10, although it could just as well be lines 4 or 9, carrying cracked product 8 in its hollow interior 18 from furnace 1 to a classical straight sided cone 7. Product 8 is the first mass flow of the gaseous cracking furnace product stream of furnace 1, and flows in a first flow direction (arrow 8) toward cone 7. Product 8 expands into the larger open interior 19 of cone 7. From interior 19, product 8 is split at upstream tube sheet face 11 and passes through the hollow interiors 26 of multiple, longitudinally extending, spaced apart heat exchange tubes 12 whose longitudinal axes are essentially in alignment with the first flow direction. Tubes 12 extend longitudinally along their long axes from upstream tube sheet face 11 to downstream tube sheet face 13. Tubes 12 terminate at downstream tube sheet face 13, and are in fluid communication with downstream outlet chamber 14 much the same as shown for members 10 and 17. Chamber 14 is typically cylindrical or conical in shape. Downstream tube sheet face 13 encloses interior 20 of exchanger 5 at the downstream end of that exchanger just like member 11 encloses the upstream end at 25. The cooled product then passes out of exchanger 5 in a conduit, not shown, in a second flow direction as shown by arrow 6.

Often, when additional tubes 12 are fitted into a new or existing internal volume 20 of exchanger 5, the angle of the adapter cone is increased. This is demonstrated in FIG. 5 for an existing exchanger by showing that the original angle 15 of the original adapter cone 17 with respect to longitudinal extension 16 of transfer line 10 is increased to that shown for cone 7 when additional tubes are added to exchanger 5.

High pressure water 21 from a conventional steam drum (not shown) is introduced into interior 20 to flow around the outer peripheries of tubes 12 to be indirectly heated by product 8 as it flows through the hollow interiors 26 of those tubes, and thereby generate a mixture of water and steam from water 21. This stream 22 is recovered from exchanger 5 at 22 for other disposition and use as desired.

As shown in FIG. 5, transfer line 10 typically has a substantially smaller cross-sectional diameter than exchanger 5. Cone 7 is shown to adapt from its small end 24 which is adjacent to and contiguous with the outlet end of transfer line 10 to its large end 25 which is adjacent to (contiguous with) upstream tube sheet inlet face 11 of exchanger 5. Thus, the mass flow rate (mass flow) of product 8 within the interior cross section of 18 passes into the larger cross sectional interior 19, and then into an equally large, if not larger, interior cross sectional area composed of the aggregate of the hollow interior area cross sections 26 of all of tubes 12 within exchanger 5.

Accordingly, the mass flow rate of product 8 in each interior 26 will be substantially smaller than the mass flow rate of product 8 in interior 18. As noted before, industry standards for the mass flow rate of product through a given tube 12 for generating optimal steam 22 are from 6 to 10 pounds per second per square foot of tube interior cross section area. Pursuant to this invention, the mass flow rate within interior 26 of each tube 12 can be significantly smaller than the 6 pounds/second/square foot minimum industry standard for producing adequate steam. Thus, it would be expected that increasing the aggregate number of tubes 12 within an expanded volume 20 would lead to greater plugging of those tubes with the aforesaid coke with low mass velocity. With the water injection aspect of this invention the tube sheet and shell diameters can be increased beyond what is normal and customary, and the resulting lower mass flow in the periphery of the necessarily wider adapter cone is accommodated without excessive coke fouling.

In accordance with this invention, a larger number of tubes 12 can be accommodated within a given volume 20 without sacrifice in steam generating capacity and without increased plugging problems. As shown by the working Examples hereinafter, by this invention, the steam capacity of an exchanger can be increased and, at the same time, the time-to-plugging lengthened.

All this is accomplished by injecting water, preferably the customary treated water, as described hereinafter into product 8 either in volume 19 of cone 7, volume 18 of transfer line 10 near small end 24 of cone 7, or both as shown in FIG. 5 at 30 and 31.

Figure 6:
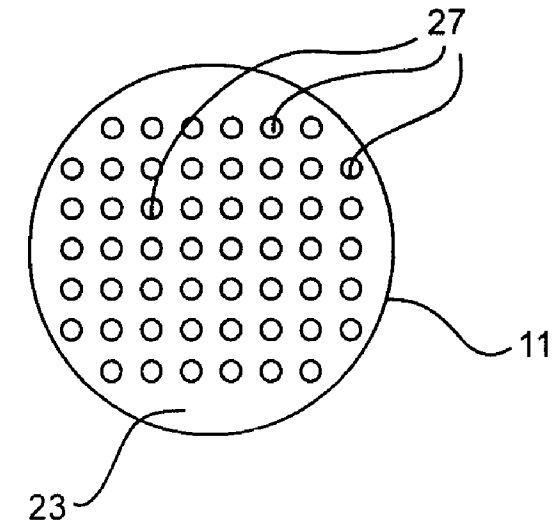
FIG. 6 shows the upstream side of an upstream tube sheet face of an exchanger.

Tube sheet face 11 is shown in FIG. 6 to be a relatively rigid member that covers the upstream end of exchanger 5, thus enclosing interior volume 20 at that upstream end. Tube sheet face 11 is normally composed of a chrome-molybdenum steel alloy or other high temperature steel allow designed to resist erosion from the impingement thereon of fast flowing, hot product 8. Since the surface of member 11 is hot, i.e., approaching the product temperature of about 1,550° F. (F) the impingement of too large a quantity of cooler liquid water thereon runs the risk of creating one or more physical cracks in member 11, which is highly undesirable. Accordingly, liquid water injection pursuant to this invention should be sufficiently dispersed and vaporized upstream of the tube sheet face 11 to avoid cracking member 11. Balanced against this, pursuant to this invention, is the consideration that within a certain distance of the water injection to member 11, the longer the time lapse before shut down and coke clean out of the unit. The exact distance from member 11 for water injection will vary according to the size and configuration of line 10, cone 7 and exchanger 5, as well as the operating conditions within those members, and the amount of water being injected. Therefore, it is impossible to quantify this distance with absolute certainty. However, such safe distances can be readily determined by one skilled in the art once appraised of the details of this invention. Generally, such a distance will be from about 12 inches to about 42 inches upstream of member 11. Depending on the length of cone 7, this will mean that the water could be injected into either a portion, e.g., upstream portion, of cone 7 or a downstream portion of line 10, or both.

FIG. 6 shows upstream side 23 of member 11 as seen from interior 19 of cone 7. This Figure also shows that member 11 is pierced by multiple upstream, spaced apart in varying arrangements, open inlet ends 27 of tubes 12 so that interior 19 of cone 7 is operationally connected (fluid flow connection) with the aggregate of interiors 26 of tubes 12.

Similarly, for the same considerations set forth above, it is impossible to quantify to a certainty the amount of water to be injected. It is, generally, that amount; given the temperature of the water injected, the injection location or locations, the equipment configuration, and the operating conditions; that will produce optimum steam production for the particular furnace/exchanger system employed, with minimal or no plugging of tubes 12, and essentially no cracking of member 11. As a guide, generally for water at about 150 F, at least about 50 pounds per hour can be injected at a distance of from about 12 inches to about 42 inches as aforesaid. As an additional guide, if the temperature of the incoming stream 8 is about 1,550 F, and the feed water 21 is at about 200 F, the system employing this invention could be operated so that with 1) hot product 8 in line 10 having a mass flow rate of about 35,000 pounds/hour/square foot of line 10 cross section, and 2) cone 7 having an internal temperature of about 1,550 F at 12 psig, the cooled product 6 leaving exchanger 5 is at a temperature of from about 525 to about 575 F, preferably about 525 F for maximum, optimal steam production at about 700 psig.

Normally, a system such as that described above operates, when tubes 12 are clean, at a relatively low pressure, e.g., about 12 psig in interior 19. As tubes 12 become plugged, the pressure within cone 7 will increase, and when it reaches a level of from about 25 to about 30 psig tubes 12 are normally sufficiently plugged with coke to require system shut down, with the consequent clean up cost and lost plant production time involved, and physical cleaning of the coke out of the interiors 26 of the tubes 12 that are plugged. Naturally, the industry desires as long a time before shut down and cleaning as possible. In conventional operation, a system is operated about 80 days before a pressure of 30 psig is reached inside cone 7, and shut down and cleaning deemed necessary. This invention can lengthen that time of operation before remedial tube cleaning is necessary.

Figure 7:
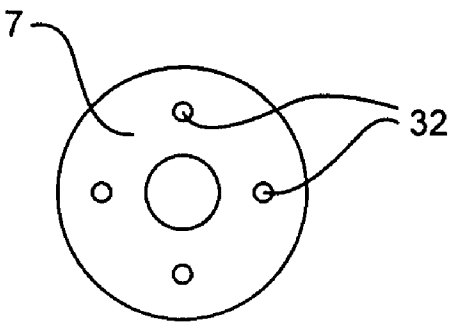
FIG. 7 shows one embodiment within this invention for injecting water upstream of an exchanger.

In accordance with this invention at least one stream of water is injected into the interior of at least one location on transfer line 10 as shown in FIG. 5 at 30 or cone 7 at 31 pursuant to the requirements set forth above. One water stream can be injected, or multiple separate streams can be injected at multiple locations on line 10 and/or cone 7. FIG. 7 shows cone 7 with four injection points (nozzles or ports) 32 that are essentially equally spaced around a central location of the periphery of cone 7. Multiple ports can be employed along the length of cone 7. Equidistant spacing of injection points is not required to achieve the results of this invention. A similar or different spacing of multiple water injection points can be made along and/or around line 10. However, water injection 30 is not made just anywhere along the full length of line 10. It is made in the downstream end of line 10 near, e.g., within about 30 inches of, upstream end 25 of exchanger 5. For example, water can be injected 1) into interior 19 of cone 7 at least about 12 inches, preferably about 18 inches, upstream from member 11, and/or 2) into interior 18 of line 10 up to about 36 inches upstream from member 11.

EXAMPLE 1

A tube-type heat exchanger as shown in FIG. 5 containing fifty six carbon steel tubes 12, each 1.75 inches in inside diameter and 26 feet long, was employed downstream of a conventional cracking furnace. The feed to the furnace was ethane. The first mass flow rate of cracked ethane furnace product in interior 18 of transfer line 10 was 35,000 pounds/hour/square foot of cross section of line 10. The temperature in interior 19 of cone 7 was 1,550 F, and initially the pressure in cone 7 was about 12 psig. The second mass flow rate of cracked furnace product in interior 26 of tubes 12 was within industry standards at 6 pounds/second/square foot of tube cross section. Boiler feed water 21, preheated to about 200 F, was passed through exchanger 5 at a rate that produced 17,000 pounds per hour of steam at a temperature of about 545 F and a pressure of about 700 psig.

After 30 days of continuous operation, the pressure inside of cone 7 had risen to about 30 psig. The operation was terminated, exchanger 5 opened, and the upstream ends 27 (FIG. 6) of tubes 12 examined for fouling. It was found that from about 30% to about 40% of tubes 12 were plugged with coke deposit to a length within interior 26 of the tubes of about 1 inch from tube sheet face inlet ends 27.

EXAMPLE 2

Example 1 was repeated except that 112 tubes 12 were employed in the same volume 20 giving a second mass flow rate within the interiors 26 of tubes 12 of 4 pounds/hour/square foot of cross section, well below industry standards. This example produced 18,000 pounds per hour of steam 22 at an outlet temperature of about 525 F and a pressure of about 700 psig.

Accordingly, the volume of steam produced was increased about 5% over that of Example 1. However, the pressure in interior 19 of cone 7 increased to 30 psig in 50 days. Upon opening exchanger 5 and examining the inlet ends 27 of tubes 12 it was found that from about 30% to about 40% of the tubes were plugged with coke in their interiors 26 to a depth of about 1 inch from inlet ends 27.

EXAMPLE 3

Example 2 was repeated except that liquid water 31 (FIG. 5) was injected around the outer periphery of cone 7 at four essentially equally spaced apart ports 7 (FIG. 7) that were in fluid communication with interior 19. The water was preheated to a temperature of about 200 F, and injected 18 inches upstream of tube face sheet 11 and tube inlets 27 at a rate of 100 pounds of water per hour per nozzle. This Example 3 produced about 17,900 pounds per hour of steam 22 at an outlet temperature of about 525 F and pressure of about 700 psig. After 105 days of continuous operation the pressure in interior 19 of cone 7 was still 12 psig, indicating no internal coking (plugging) of tubes 12.

EXAMPLE 4

Example 3 was repeated except that, instead of water injection into the interior of cone 7, liquid water 30 (FIG. 5) was injected at four essentially equally spaced apart ports located around the outer periphery of transfer line 10 and in fluid communication with interior 18. The preheated water was injected at the same rate as Example 3, but 30 inches upstream of tube face sheet 11 and tube inlets 27. This Example 4 also produced about 17,900 pounds per hour of steam 22 at an outlet temperature of about 525 F. After 105 days of continuous operation, the pressure in interior 19 of cone 7 was still 12 psig, indicating no internal coking of tubes 12.

Accordingly, it can be seen from the above Examples that by the practice of this invention, steam production was increased even at substandard mass flow rates inside tubes 12, and independently of cone angle.

Reasonable variation and modifications are possible within the scope of this disclosure without departing from the spirit and scope of this invention.

We claim:

1. In a method for thermally cracking a hydrocarbonaceous material to form a cracked product wherein said stream is passed through at least one furnace to cause said cracking and form a furnace product, said furnace product being transferred from said furnace in a first flow direction to at least one tube-type heat exchanger which has an upstream end and a downstream end and which contains a plurality of longitudinally extending spaced apart hollow interior heat exchange tubes extending from said upstream end to said downstream end for transporting said furnace product through said heat exchanger, the longitudinal axes of said tubes being essentially in alignment with said first flow direction and extending from said upstream end of said tubes and heat exchanger to said downstream end of said tubes and heat exchanger, said upstream ends of said tubes being inlet ends that terminate with a tube sheet face, said transfer from said furnace to said heat exchanger being effected through at least one transfer line which has an open interior that ends at its downstream end at a conical adapter carried on the upstream end of said heat exchanger, said adapter having an open interior, a small cross sectional upstream end adjacent said transfer line and a larger cross sectional downstream end adjacent said upstream tube face sheet, said small end operationally connecting said interior of said transfer line to said interior of said adapter, said large end operationally connecting said interior of said adapter through said upstream tube sheet face and tube inlet ends to said hollow interiors of said tubes, said transfer line carrying a first mass flow rate of said furnace product, the improvement comprising providing an increased number of heat exchange tubes in said heat exchanger and providing said adapter with a larger cross sectional downstream end thereby resulting in a second lower mass flow rate through said adapter and tubes, passing said furnace product at said first mass flow rate through said transfer line and said second lower mass flow rate through said adapter in said first flow direction to said tube sheet face and then through said hollow interiors of said tubes toward said downstream end of said heat exchanger at said second mass flow rate that is less than said first mass flow rate, and at least part of the time said furnace product is passed through said transfer line and adapter injecting liquid water into said furnace product upstream of said tube sheet face.

2. The method of claim 1 wherein said water is injected into at least one of said interior of said upstream conical adapter, and said interior of said transfer line.

3. The method of claim 1 wherein said conical adapter is a truncated flat sided cone, and said water is injected into said interior of said upstream truncated cone.

4. The method of claim 1 wherein said water is injected into said interior of said transfer line.

5. The method of claim 1 wherein said water is injected into said interior of said conical adapter at least about 12 inches upstream from said upstream tube sheet face.

6. The method of claim 1 wherein said water is injected into said interior of said transfer line up to about 42 inches upstream from said upstream tube sheet face.

7. The method of claim 1 wherein said water is continuously injected into said furnace product.

8. The method of claim 1 wherein said water is injected at a plurality of spaced apart points around the periphery of at least one of said transfer line and said upstream conical adapter.

9. The method of claim 1 wherein said water is at a temperature of at least about 150 F and is injected at a rate of at least about 50 pounds per hour.

10. The method of claim 1 wherein said first mass flow rate is thousands of pounds per hour per square foot while said second mass flow rate is less than 6 pounds per second per square foot.

* * * * *